US006321956B1

(12) United States Patent
Elder

(10) Patent No.: US 6,321,956 B1
(45) Date of Patent: Nov. 27, 2001

(54) PAINTBALL GUN SUPPORT SYSTEM FOR LOADING PAINTBALL PELLETS AND GAS CYLINDERS

(76) Inventor: Max L. Elder, 6451 W. 28th St., Berwyn, IL (US) 60402

( * ) Notice: Subject to any disclaimer, the term of this patent is extended or adjusted under 35 U.S.C. 154(b) by 0 days.

(21) Appl. No.: 09/318,497

(22) Filed: May 25, 1999

(51) Int. Cl.[7] ..... F41C 23/02
(52) U.S. Cl. ..... 224/150; 224/149; 224/913
(58) Field of Search ..... 224/149, 150, 224/913, 271; 211/64

(56) References Cited

U.S. PATENT DOCUMENTS 2,526,768 10/1950 Pendergrass .
4,431,122 2/1984 Garmong .
5,680,939 * 10/1997 Oliver ..... 224/150
5,697,181 * 12/1997 Savant ..... 224/913 X
5,725,135 3/1998 Daniel .
5,988,466 * 11/1999 Brown ..... 224/913 X

* cited by examiner

*Primary Examiner*—Stephen K. Cronin
*Assistant Examiner*—Maerena Brevard
(74) *Attorney, Agent, or Firm*—Patula & Associates P.C.

(57) ABSTRACT

A gun support system for a paintball gun comprises a support frame and a strap attached thereto. The support frame consists of a bracket and a support arm. The bracket is defined by an opening and has a front side. The support arm has a proximal and distal end and extends outwardly from the front side of the bracket. The system may also consist of an adjustable opening thereby providing the support of various different paintball gun sizes and shapes. The system may also consist of an adjustable support arm to better support guns with a larger nozzle.

19 Claims, 9 Drawing Sheets

PAINTBALL GUN SUPPORT SYSTEM FOR LOADING PAINTBALL PELLETS AND GAS CYLINDERS

BACKGROUND OF THE INVENTION

1. Field of the Invention

The instant invention relates generally to a paintball gun support system for loading paintball pellets and gas cylinder.

The instant invention provides a support system for a paintball gun with attachment means for a strap. The support system supports the gun at the butt of the gun while the strap rests upon a users shoulder or back of the neck. The paintball gun while in the support system provides the user with a handsfree approach to loading and unloading of paintball pellets and/or gas cylinders.

2. Description of Related Art

Since its inception, the game of paintball has become increasingly popular. The game is played outside, usually in a field or a semi-wooded area. The game is typically played with two teams made up of approximately 5–20 players per team. Each player carriers a compressed air-powered gun that shoots paintballs a considerable distance. During the game the players must be mobile, spending most of the time either running or hiding from opposing team members. When the game starts the individual player's participation in the game does not end until the game is over or that player is hit with a paintball. Players discharge or fire their paintball gun upon seeing the opposing team members, in order to attempt to remove the opposing player from the playing field. It is not unlikely for a player's participation in a game to last a couple of minutes but may last as long as an hour.

A typical sophisticated paintball gun uses gas cylinders to fire the paintball pellets. The high firing rate of these sophisticated paintball guns has necessitated paintball pellet loaders. These loaders may typically store 100–200 paintball pellets, which feed directly into the paintball gun. It is not uncommon to fire 400–1000 paintball pellets during a single game. Therefore, a player may have to reload the paintball gun or loader anywhere from 2 to 6 times. Also, it is not uncommon to have to reload the gas cylinder during the game and while on the move.

Furthermore, upon discharging the paintball pellets, the barrel of the paintball gun may become clogged with pieces of pellets or paint from the pellets. Therefore before loading another paintball pellet loader it is common to clean the barrel before refiring the gun. Typically the barrel is cleaned with a barrel cleaner. However, the barrel cleaner may be cumbersome to carrying during the game because it cannot be bent. If the rod becomes bent than it may not adequately clean the inside of the barrel or may scratch or damage the inside of the barrel. It is therefore desirous to keep the barrel cleaner handy during a paintball game but placed in such a way as to prevent the barrel cleaner from becoming damaged. Therefor it may be desirous to attach the barrel cleaner to the support system.

Since a player cannot leave the game in order to reload their paintball gun the player must reload their gun during the game. A player may be in any number of positions when their gun needs reloading, for instance, a player may be running from opposing team members or hiding in a tree. Even if a player is leaning against a tree or knelling on the ground, a player usually does not want to lay their gun on the ground to reload the gun if the ground is wet or muddy. Therefore, there has long been a desire to have a support or holder for a paintball gun which allows the user to have their hands free to reload the paintball gun's pellets or gas cylinders without dropping or placing the gun on the ground. Furthermore, since a player may be running, climbing or crawling when their gun needs to be reloaded it is also desirous to have a support which allows the user to be mobile or agile while reloading the gun. Still further, it is a well known facet of the game to be able to fire the gun immediately after reloading. Therefore, it is also desirous to place the gun in a support which allows the gun to be fired, without having to remove the gun from the support.

Gun supports, holsters, and carriers in other related fields have long been employed to provide a gun with support, when the gun is not being fired or held. Such supports are generally cumbersome because they must be attached to the user's belts or vests or require the user to wear such belts or vests in order to use the supports. These supports or holders merely provide a support or a rest position for the gun and do not allow the gun to be reloaded and/or fired, especially on the move.

Other supports are specifically designed to hold or position the gun while firing, not providing the user with mobility or agility when operating the gun. These types of supports, slings or holders are specifically designed to reduce mobility in order to assist the user to line up a shot and support the gun while firing.

There does not exist in the art a support which provides mobility and stability to allow the user to have their hands free to conduct various tasks. For instance to load and unload paintball pellets or gas cylinders or to clean the barrel of the gun with a rod cleaner. However, it is further desired to be able to fire the gun while in the support in order to maximize the mobility and agility of the support.

Prior attempts at providing a gun support have failed to appreciate these important aspect which the present invention fully encompasses. U.S. Pat. No. 5,725,135 to Daniel represents a "Shotgun Holster." Daniel discloses a device that is worn around the waist of the user to support a shotgun only during non-use. (Col. 1, lines 33–40). Daniel does not disclose, teach or suggest the use of any type of holster while the Shotgun is in use, thereby distinguishing itself from the present invention.

U.S. Pat. No. 2,526,768 to Pendergrass represents a "Safety Gun Rest." However, Pendergrass shows a gun rest which is awkwardly attached to a shoulder strap or jacket. Furthermore, Pendergrass discloses that while a gun is placed in the "Safety Gun Rest" the gun may not be used, minimizing the chance of the gun accidentally firing.

U.S. Pat. No. 4,431,122 to Garmong represents another type of "Gun Rest." Garmong discloses an open gun rest which the user places the gun in the rest only for a limited time. In order to fire the gun using the device of Garmong, the gun must be retrieved from the rest. Furthermore, the gun must be balanced by the user in the rest in order to stabilize the gun; otherwise, the gun may fall out of the rest on to the ground.

It is therefore an object of the instant invention to provide a means to support the paintball gun with a handsfree approach. In other words, the paintball gun is supported such that the user does not have to hold the paintball gun. This provides the user with the ability to use their hands for various tasks, such as loading and unloading the gun with paintball pellets or gas cylinders or cleaning the barrel of the gun with a rod cleaner.

It is a further object of the instant invention to have the paintball gun in a support at all times which allows a user to fire the gun while in the support, without having to remove the paintball gun from the cumbersome rest or support.

It is still another object of the instant invention to provide a support that securely fastens the paintball gun to the support, preventing the paintball gun from falling out of the support and onto the ground.

SUMMARY OF THE INVENTION

The above and other objects of the instant invention are accomplished by providing a gun support system for carrying a paintball gun. The gun support system consists of a support frame and a strap attached thereto. The support frame consists of a bracket and a support arm. The bracket is mainly defined by an opening and has a front side. The support arm has a proximal and distal end and extends outwardly from the front side of the bracket. The support further includes attachment means for a strap.

The gun support may also consist of an adjustable opening thereby providing the support of various different paintball gun sizes and shapes. The gun support may also consist of an adjustable support arm to better support guns with a larger nozzle.

The instant invention is fully appreciated by placing the gun in the bracket such that the barrel of gun rest along side of the support arm. The strap is then placed around the users neck and/or shoulder, providing the necessary support for the paintball gun and allowing the user to have their hands free in order to reload or load the paintball gun with paintball pellets or gas cylinders.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENTS OF THE PRESENT INVENTION

Figure 1:
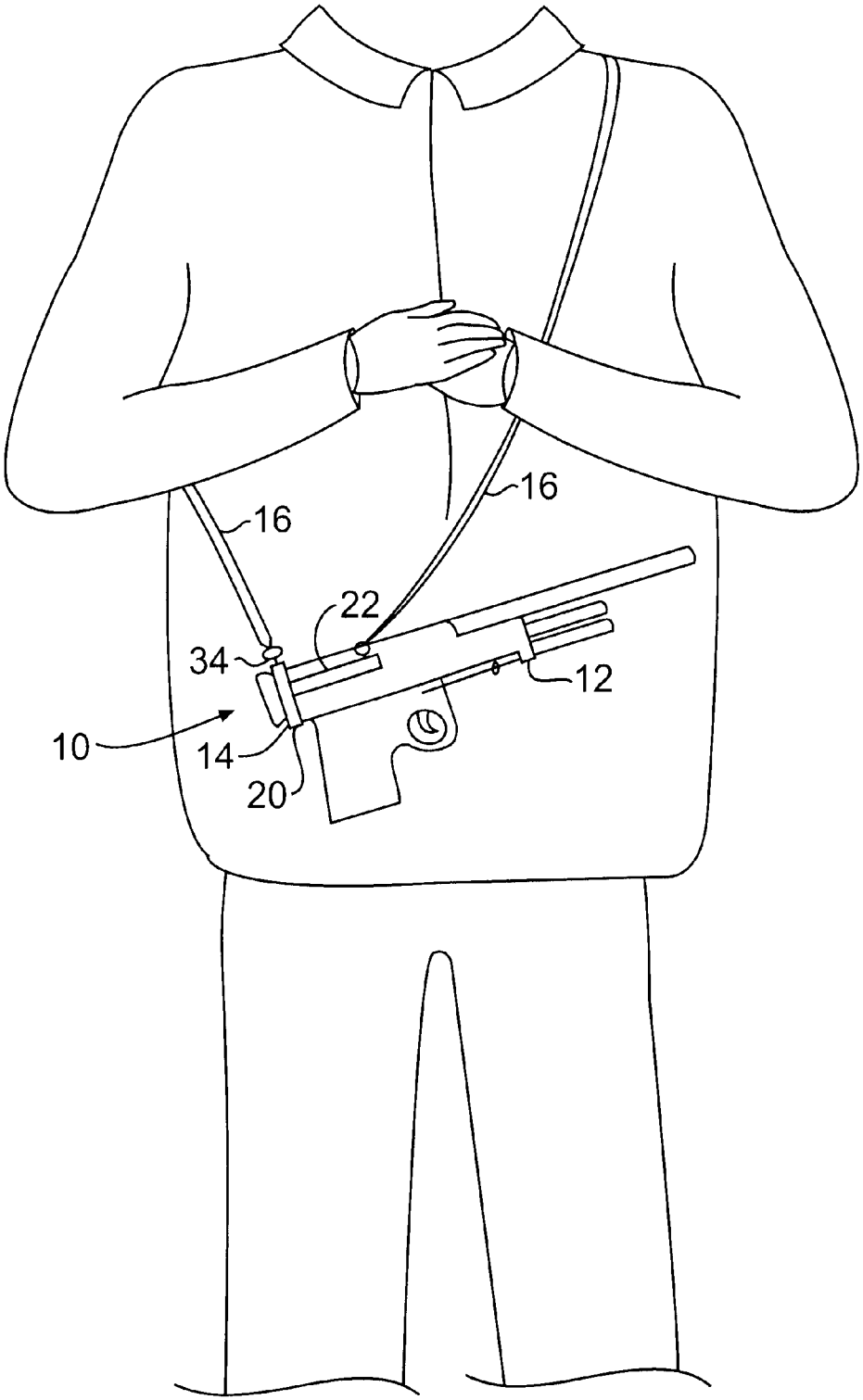
FIG. 1 is a front plan view, showing the figure of a man carrying a paintball gun supported in the support frame in accordance with the present invention.

While the invention is susceptible of embodiments in many different forms, there is shown in the drawings and will be described herein, in detail, the preferred embodiments of the invention. It should be understood, however, that the present disclosure is to be considered an exemplification of the principles of the invention and is not intended to limit the spirit and scope of the invention and/or claims of the embodiments illustrated.

In the following description, similar components are referred to by the same reference numeral in order to simplify the understanding of the sequential aspect of the drawings.

Referring now to FIG. 1 a handsfree paintball gun support system (hereinafter support system) 10 is shown according to a preferred embodiment. FIG. 1 depicts the support system 10 being worn by a user and supporting a gun 12. The support system 10 consists of a support frame 14 and a strap 16. The support frame 14 utilizes the strap 16 to support the paintball gun. The strap 16 is preferably adjustable strap allowing the user to adjust the height at which the support bracket rests. The strap when adjusted is either passed over one shoulder of the user and under his opposite arm; or passed over the user's head resting on the back of the user's neck whereby the strap supports the support frame 14 at any suitable, selected height.

Figure 2:
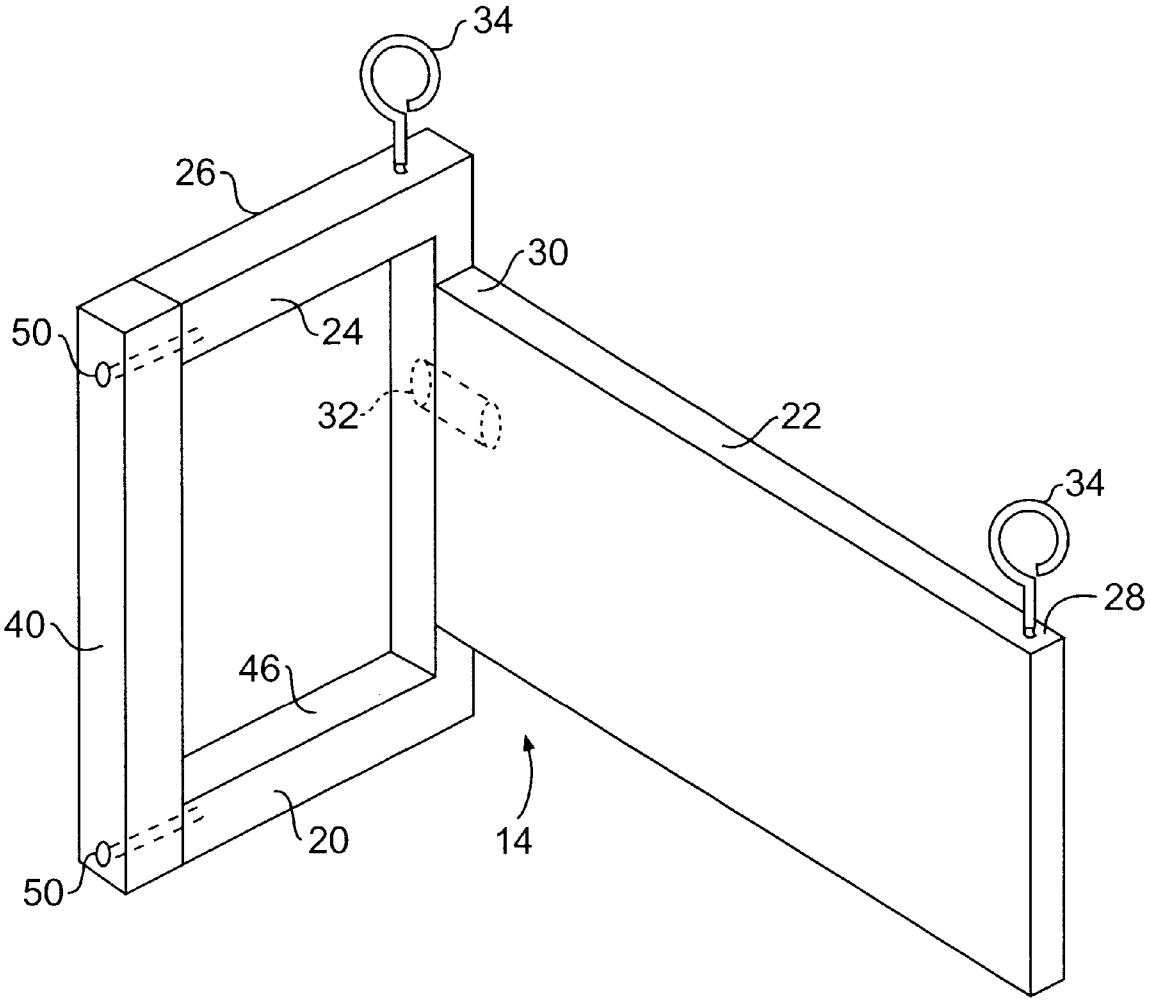
FIG. 2 depicts a perspective view of the preferred embodiment of the present invention.

The support frame 14 as shown in its completed form in FIGS. 1 and 2 generally consists of a bracket 20 and a support arm 22. The support frame 14 is preferably fabricated, molded or casted from such suitable material as stainless steel, aluminum or a polycorbonate.

The bracket 20 is defined by an opening and has a front side 24 and a back side 26. The support arm 22 (further discussed herein below) generally has a distal end 28 and a proximal end 30. The proximal end 30 is preferably attached to the front side 24 of the bracket 20 by attaching means 32. However, the support arm 22 may be integrally molded to the bracket 20 during manufacturing.

Strap 16 (not shown) engages the support frame 14 by a means for engaging 34. The means for engaging 34 is preferably hooks, however, any suitable means well-known in the art may be used. As depicted in FIG. 2 the means for engaging 34 are placed on the bracket 20 and the distal end 28 of the support arm 22. It is fully appreciated by this invention that the means for engaging 34 may be placed on the support frame at any suitable position.

Figure 3A:
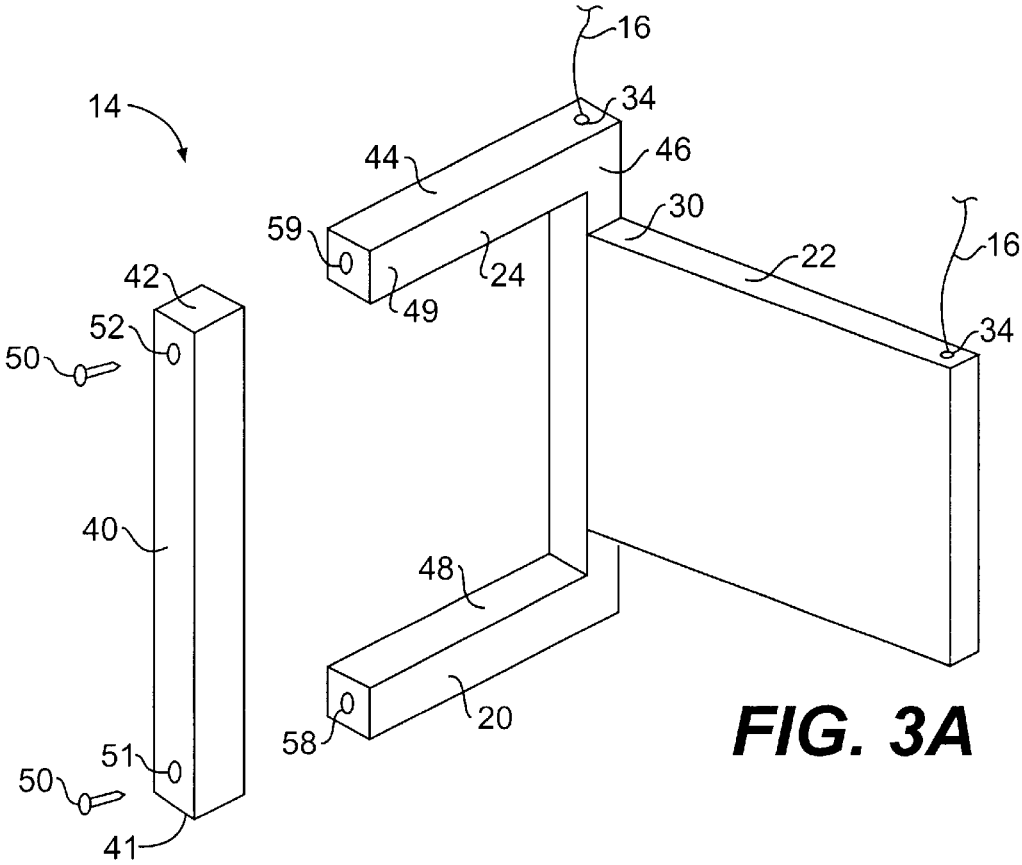
FIGS. 3*a* and 3*b* depict an exploded perspective view of the preferred embodiment of the present invention.
Figure 3B:
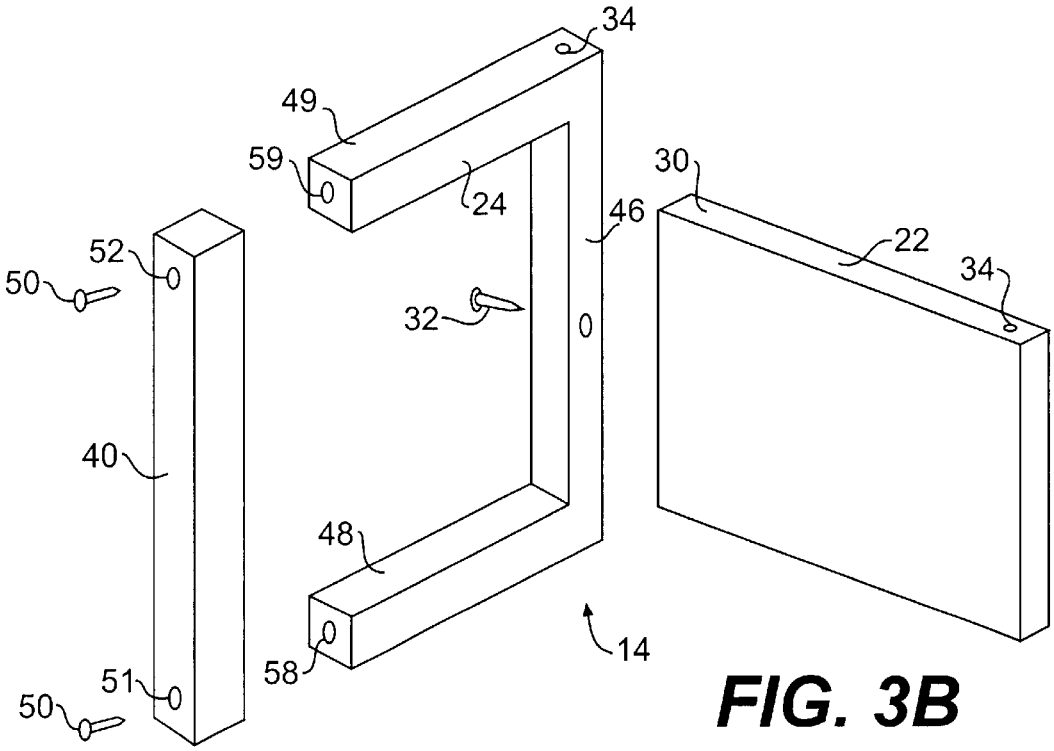

Referring now to FIGS. 3*a* and 3*b* the support frame 14 of the present invention is depicted. The bracket 20 comprises an end member 40 with two ends 41 and 42 and an open ended member 44. The open ended member 44 has a closed end 46 and two leg members 48, 49. The bracket is formed by removably fastening the end member 40 to the open ended member 44 by a means for fastening 50. The means for fastening 50 is preferably a pair of pins but it is understood that various other means for fastening in the art may be used.

In the preferred embodiment of the present invention, each end 41 and 42 of the end member 40 has a hole 51 and 52, respectively. Furthermore, each leg members 48 and 49 has a hole 58, and 59, respectively, which corresponds to the holes in the end member 40 The means for fastening 50 is inserted into one of the holes (51, or 52) in the end member and then inserted into one of the holes (58 or 59) of the leg members thereby fastening the end member 40 to the open ended member 44.

Extending outwardly from the bracket 20 is the support arm 22. As shown in FIG. 3*b* the proximal end 30 of the support arm 22 is preferably fastened to the front end 24 of bracket 20 by attaching means 32. The support arm 22 is fastened to the bracket 20 in any suitable position, however, in the preferred embodiment the support arm 22 is fastened to the closed end 46 of the open ended member 44. Support arm 22 is preferably attached perpendicularly to the opening of the bracket 20. However, it is fully appreciated by this invention that the support arm 22 may be attached in at any suitable angle or position in order to accompany various designs of paintball guns.

The bracket 20 when formed defines an opening, best seen in FIG. 2. The opening is preferably square shaped, however, the shape or size of the opening could take any suitable form according to the spirit and appreciation of the present invention. For instance, different paintball guns may have gun butts with different shapes and sizes, therefore, it is contemplated that the shape or size of the opening is formed such that the gun support may accept many different shapes and sizes of paintball gun butts. In the preferred embodiment of the invention the bracket frictionally engages the gun butt such that the gun while resting in the support system does not rotate or fall out of the system. It is also preferred that the bracket opening may be adjustable on one or more sides in order to accept the different sizes and shapes of paintball guns.

Figure 4A:
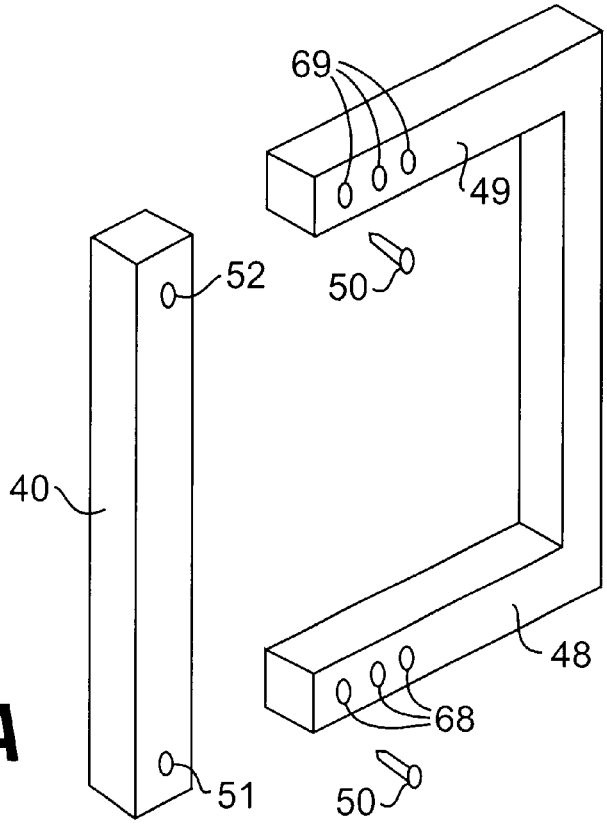
FIGS. 4*a*, 4*b*, and 4*c*, 4*d*, 4*e* and 4*f* depict perspective views of alternate embodiments of an adjustable opening for the present invention.

Referring now to FIGS. 4*a*, 4*b*, 4*c*, 4*d*, 4*e*, and 4*f*, various means for adjusting the opening of the bracket 20 are depicted. FIG. 4*a* depicts the leg members 48 and 49 of the open ended member 44, each having a plurality of holes 68 and 69, respectively. The holes 51 and 52 of end member 40 line up with a pair of holes in the leg members. The means for fastening 50 is then inserted into the holes, fastening the end member 40 to the open ended member 44. The opening of the bracket 20 is adjustable in that the holes 51 and 52 of the end member 40 may be lined up against a different pair of holes 68 and 69 in the leg members.

Figure 4B:
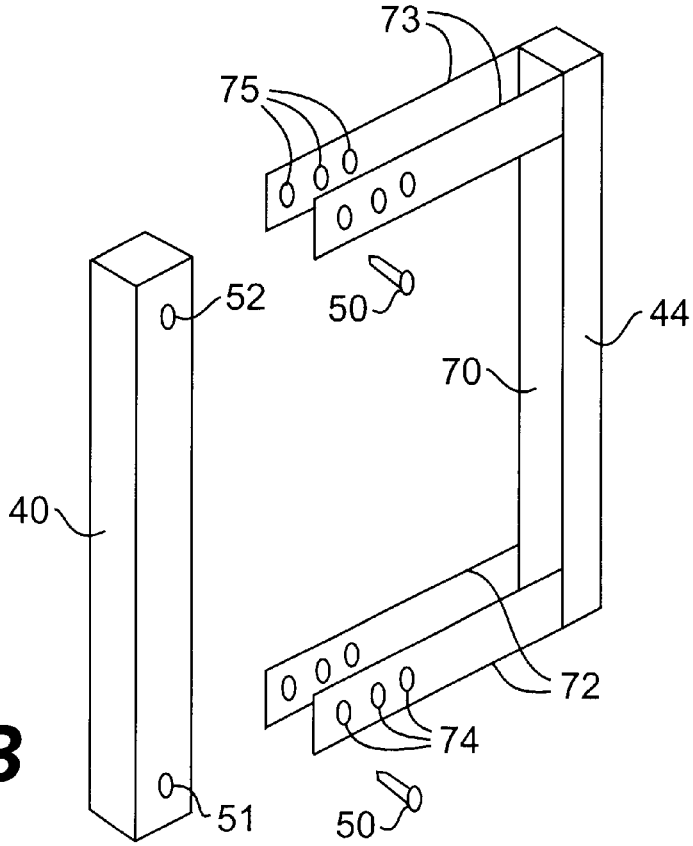

FIG. 4*b* depicts another embodiment of the means for adjusting the opening of the bracket 20. The open ended member 44 has a body 70 and a pair of elements 72 and 73 extending outwardly from the body 70. Each element has a plurality of holes 74 and 75. The end member 40 is placed between the elements 72 and 73 such that the holes 51 and 52 on the end member 40 line up to a pair of holes of the plurality of holes 74 and 75. The means for fastening 50 is then inserted into the holes, fastening the end member 40 to the open ended member 44.

Figure 4C:
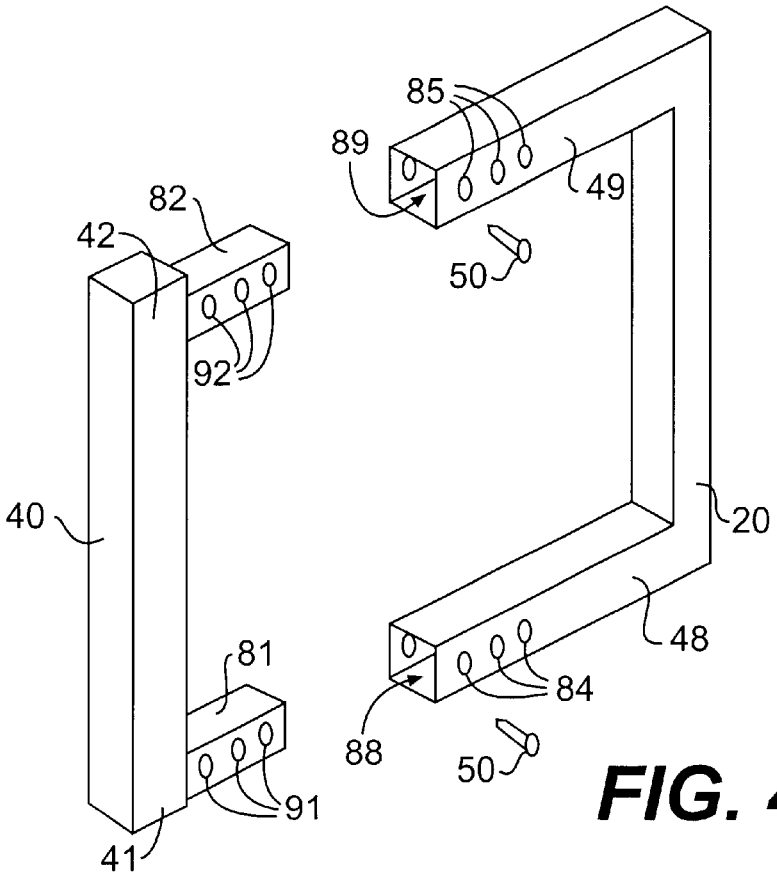

FIG. 4*c* depicts another embodiment of the means for adjusting the opening of the bracket 20. The two leg members 48 and 49 of the open ended member 44 each have a cavity, 88 and 89, respectively, formed at the ends of the leg members 48 and 49, such that the leg members are hollow. The ends 41 and 42 of the end member 40 each have a protruding element 81 and 82, respectively. The perimeter of the protruding elements 81 and 82 are smaller than the perimeters of the cavities 88 and 89 of the leg members 48 and 49, such that the protruding elements may be inserted into the cavities. Each leg member 48 and 49 has a plurality of holes 84 and 85, respectively, and each protruding elements 81 and 82 has a plurality of holes 91 and 92, respectively. The protruding elements are inserted into the respective cavities and the holes on each of them are aligned, thereby creating a preferred opening. The means for fastening 50 is then inserted into one of the plurality of holes on each leg member and into one of the plurality of holes on each protruding elements, fastening the end member 40 to the open ended member 44.

Figure 4D:
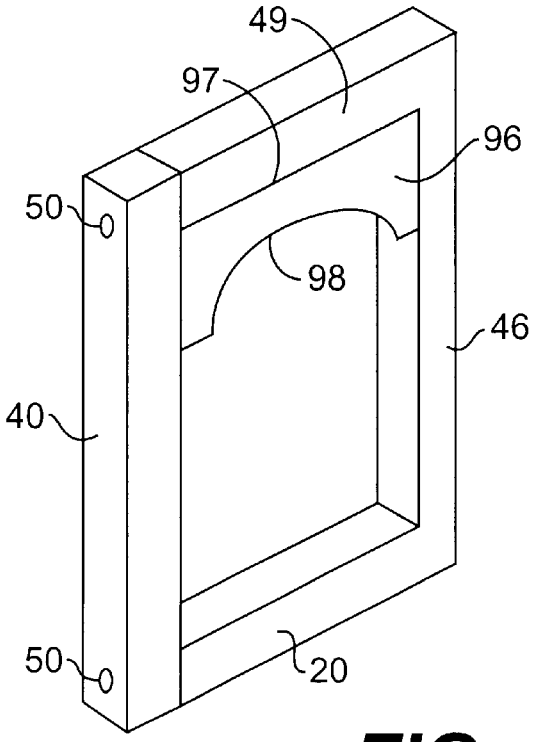
Figure 4E:
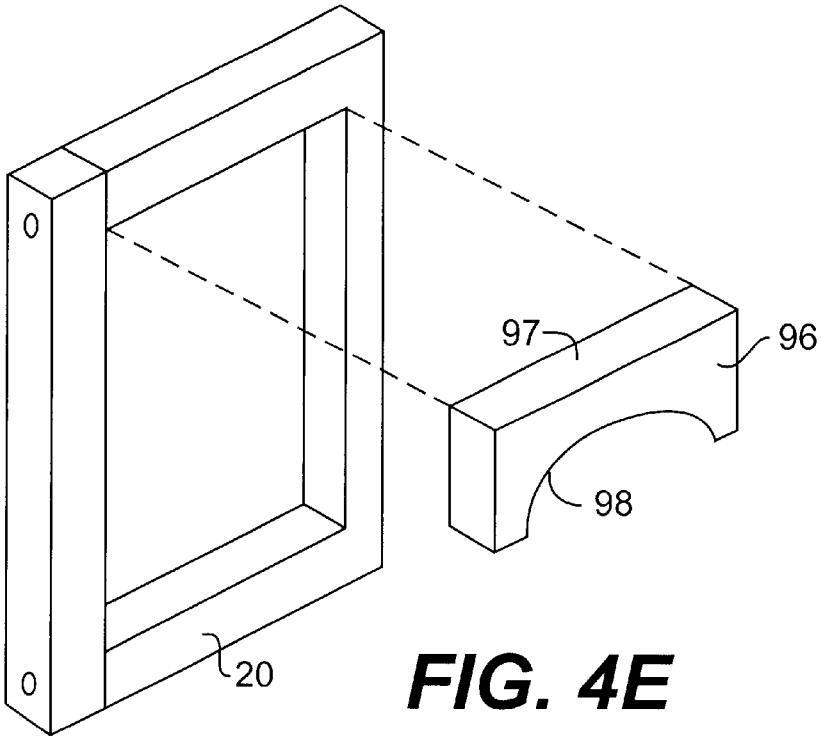

Referring now to FIG. 4*d* it is shown an alternate embodiment of the means for adjusting the opening of the bracket 20. An insert 96 having a base portion 97 and lower portion 98 may be positioned in the opening of the bracket 20. The lower portion 98 preferably has an arc shape thereby conforming the opening to accept paintball guns with circular or rounded shapes.

The insert 96 may be frictionally fitted in the interior of the opening of the bracket 20 or attached by any suitable means. As shown, the base portion 97 is positioned against the closed end 46, leg member 49 and the end member 40. However, the base portion may be placed in any suitable position. Preferably, the insert 96 is placed in the opening of the bracket 20 before the end member 40 is secured to the bracket 20 by means for fastening 50. However, the adapter may be designed such that it slides into the opening of the bracket after the end member is secured to the bracket shown in FIG. 4*e*. As such, the adapter may be secured to the bracket by pins or other known fastening means.

Figure 4F:
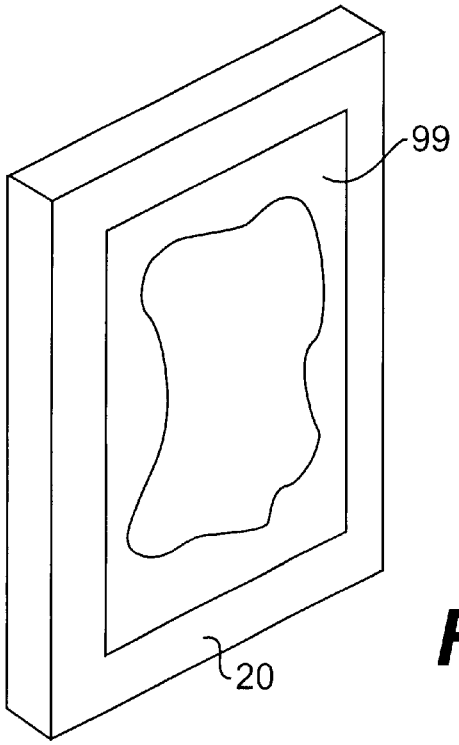

FIG. 4*f* depicts yet another embodiment of the means for adjusting the opening of bracket 20. As shown the bracket 20 is a unitary piece having an opening large enough to accept various sized paintball guns. The opening of the bracket 20 has a perimeter along which a flexible rubber member 99 is affixed. The flexible rubber member may be affixed in the opening by any suitable means known in the art such as adhesives. When in use, a paintball gun is placed through the opening, and the flexible rubber member frictionally grips the paintball gun in the bracket 20. After use, the gun may be removed by pulling the gun out of the opening, at which time a different sized gun may be placed therethrough.

Figure 5A:
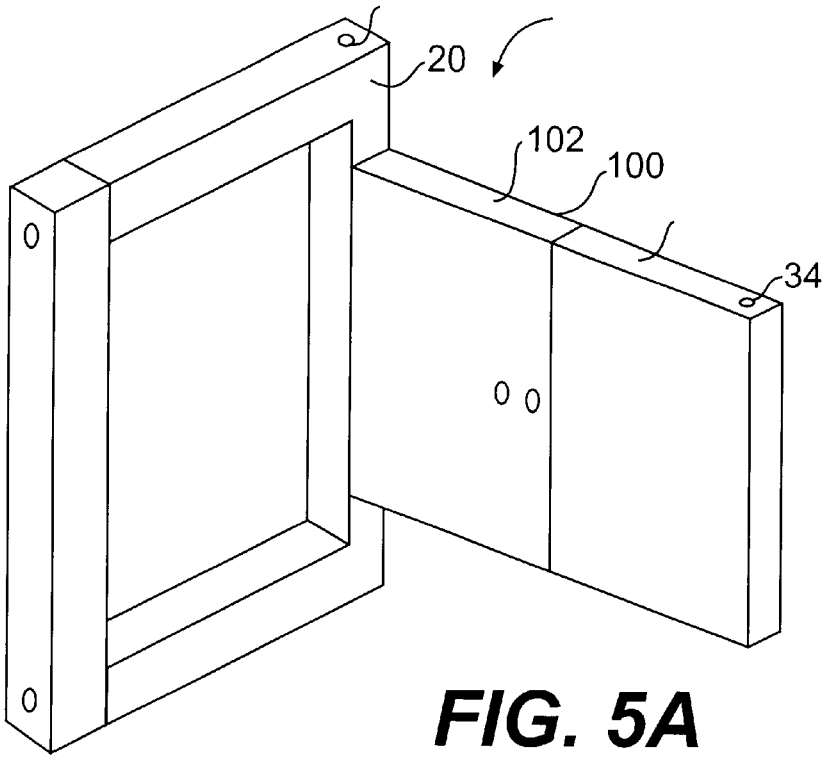
FIGS. 5*a* and 5*b* depict perspective views of alternate embodiments of an adjustable support arm for the present invention.
Figure 5B:
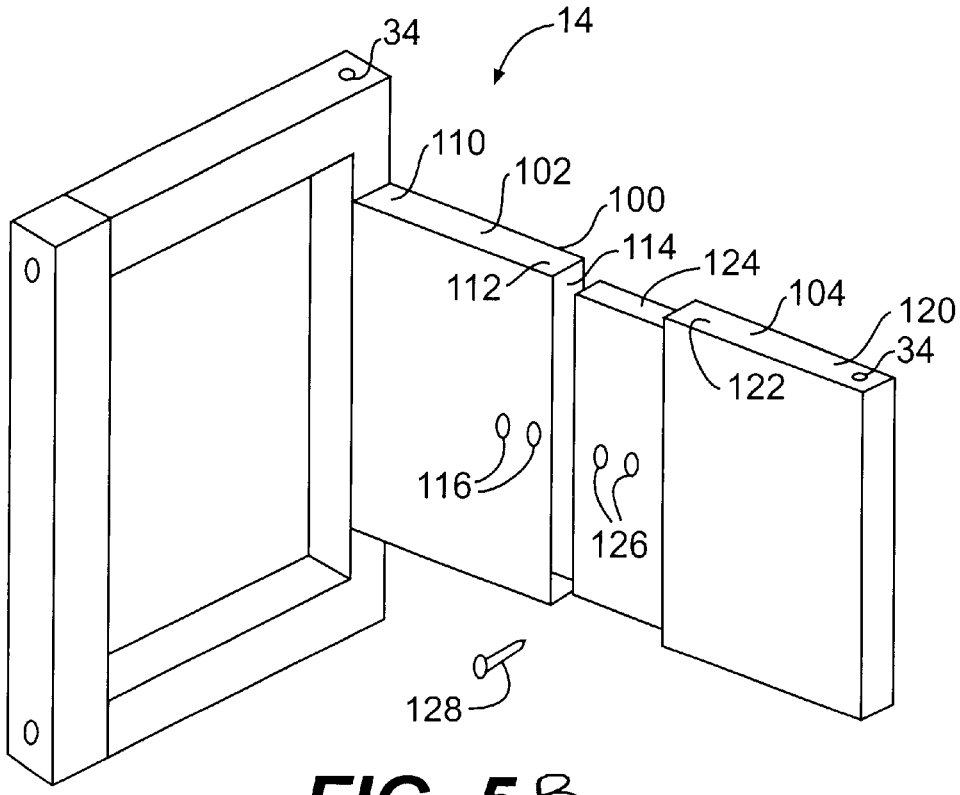

Since paintball guns employ many different sizes and lengths it may also be advantageous to employ a support frame with an adjustable support arm. The adjustable support arm will provide added length of support for longer guns or weapons. In one embodiment of the present invention, shown in FIGS. 5*a* and 5*b*, the support frame 14 includes an adjustable support arm 100. FIG. 5*a* shows the adjustable support arm connected, while FIG. 5*b* shows the adjustable support arm 100 segmented.

The adjustable support arm has two pieces, a first piece 102 and a second piece 104. The first piece 102 has two ends 110 and 112 and is attached to the support bracket 20 by one of the ends 110. Furthermore, at the other end 112, the first piece has a cavity 114 and a plurality of holes 116. The second piece 104 also has two ends 120 and 122. One of the ends 122 has a protruding element 124. The perimeter of the protruding element is smaller than the cavity 114 such that the protruding edge may be inserted into the cavity. The protruding element 122 also contains a plurality of holes 126.

When connected as in FIG. 5*a*, a means for fastening 130 is inserted into one of the plurality of holes 116 on the first piece 102 and into one of the plurality of holes 126 on the second piece 104, fastening the first piece to the second piece at a desired length.

Figure 6A:
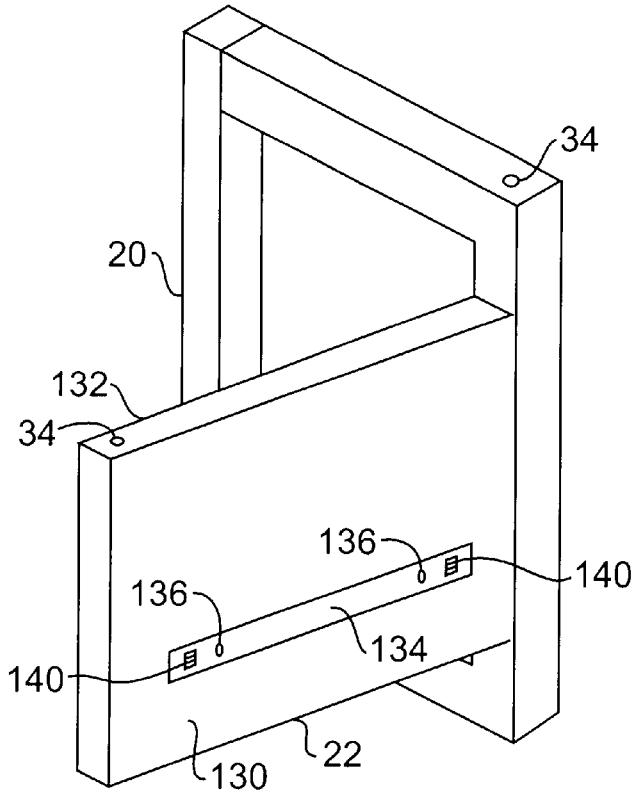
FIGS. 6*a* and 6*b* depict perspective views of alternate embodiments of means for holding a barrel rod cleaner the present invention.
Figure 6B:
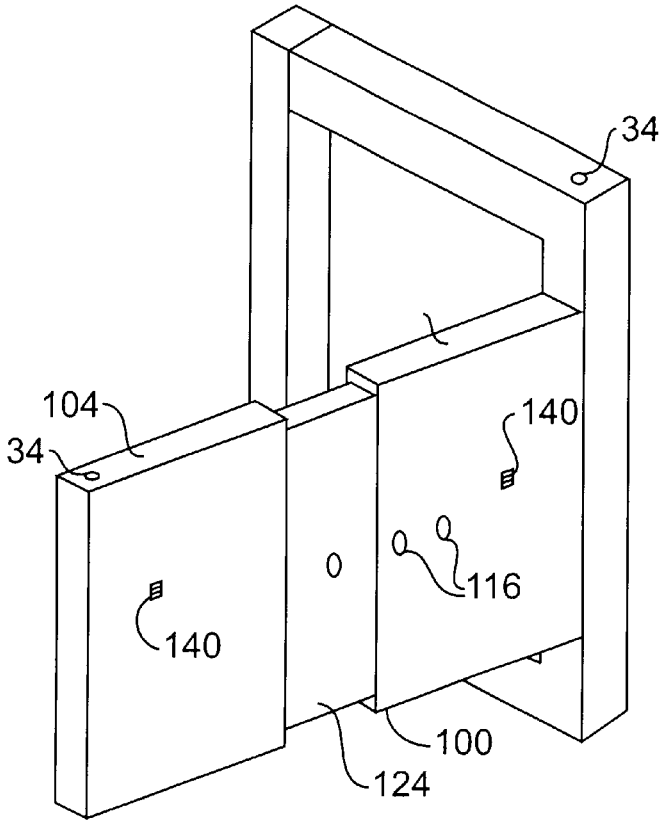

Referring now to FIGS. 6*a* and 6*b*, means for gripping a barrel rod cleaner are depicted. In FIG. 6*a*, the support arm 22 is a single unitary piece. Support arm 22 has an exterior side 130 and a interior side 132. When in use, a paintball gun barrel rests up against the interior side 132 of support arm 22. A means for gripping a barrel rod cleaner is attached to the support arm 22. The means for gripping is attached to the support arm such that the rod cleaner (not shown) does not interfere with the paintball gun, preferably attached to the exterior side 130.

The means for gripping preferably consists of a holder 134 secured to the exterior side 130 of the support arm 22 by any conventional securing means 136 well known in the art, such as screws, pins or adhesive. The holder 134 has a pair of rod holders 140 positioned on the holder 134. The rod holders 140 frictionally grip or clip the rod cleaner such that the rod cleaner may be easily removed to clean a gun barrel and replaced after use.

Referring now to FIG. 6*b*, the support arm is an adjustable support arm 100. For use with an adjustable support arm 100 the means for gripping a barrel rod cleaner may consist of a pair of rod holders 140. Each rod holder 140 may be attached to a separate segment of the adjustable support arm 100, the first piece 102 and the second piece 104, respectively.

Figure 7:
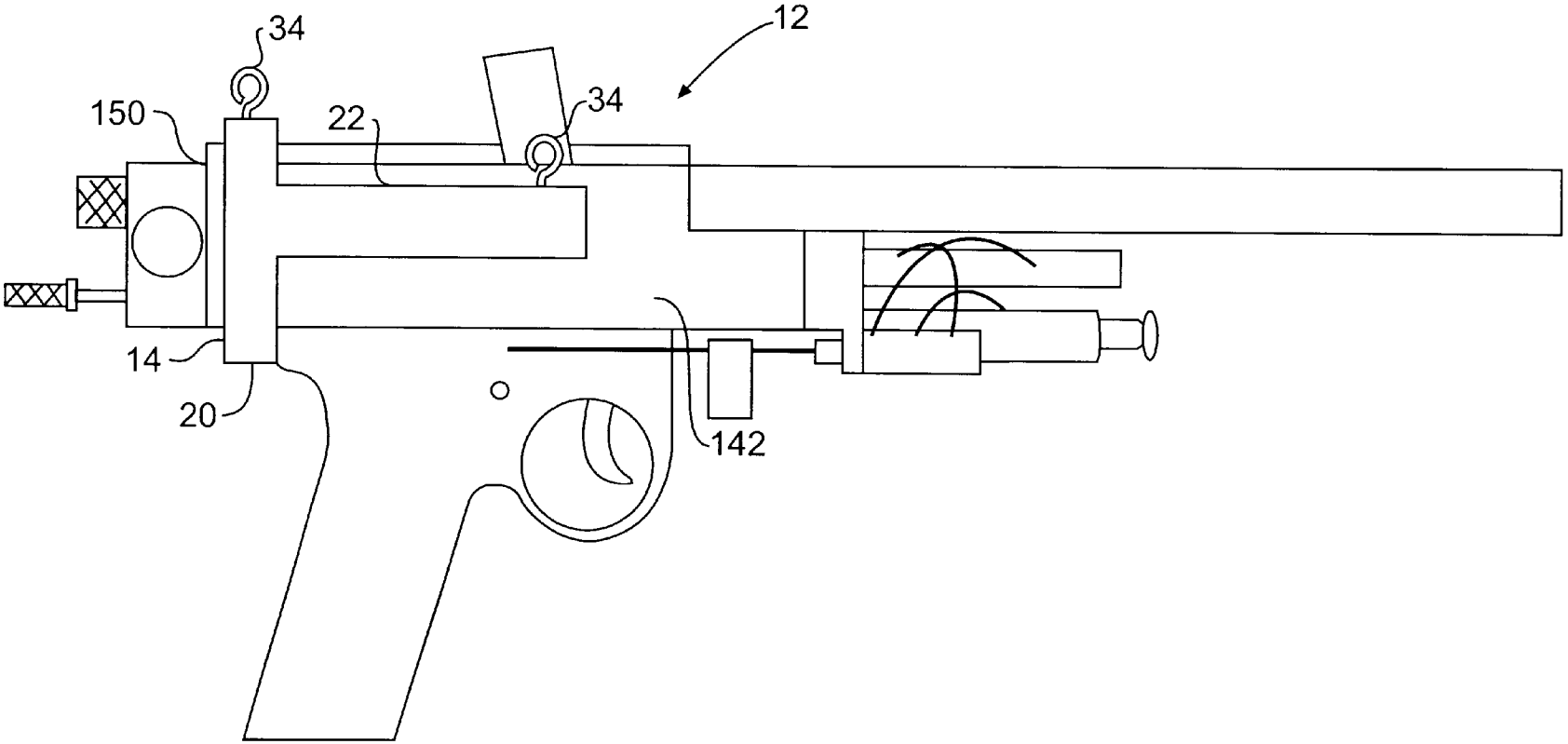
FIG. 7 depicts a front plan view of the preferred embodiment supporting a gun in accordance with the present invention.

Referring now to FIG. 7 in operation the gun butt 150 of the paintball gun 12 is placed in the open ended member 44 of bracket 20 before the end member 40 is fastened. Thereafter the end member 40 is fastened to the open ended member 44, securely fastening or frictionally engaging the paintball gun in support frame 14.

The gun is placed in the bracket 20 such that the gun frame 142 extends along the support arm 22. The support arm 22 rests along the frame 142 providing extra support to the gun support system 10.

The strap 16 is attached to the support frame 14 by the means for engaging 34. In the preferred embodiment the strap is attached to the bracket 20 and the distal end 28 and the support arm 22. By attaching the strap to the opposite ends of the support system the gun is supported at a leveled position. The strap is then placed over the user's shoulder or head allowing the paintball gun to rest on the side of or in front of the user.

When in use the support system provides the user with the ability to load the paintball gun with paint pellets; load or unload the paintball gun with gas cylinders; or other various tasks which require the use of the user's hands. Furthermore, the paintball gun may be secured in the support system while in use. The support system does not interfere with the normal operations of the paintball gun and may be attached to the paintball gun at all times.

The forgoing specification describes only the preferred embodiments of the invention as shown. Other embodiments besides those presented above may be articulated as well. The terms and expressions, therefore, serve only to describe the invention by example only and not to limit the invention. It is expected that others will perceive differences which, while differing from the foregoing, do not depart from the spirit and scope of the invention herein described and claimed.

I claim:

1. A gun support system comprising:

a support frame having a bracket and a support arm;

said bracket being defined by an opening and a front side;

said support arm having a proximal and distal end, and said support arm extending outwardly from said front side of said bracket; and a means for engaging a support strap to said support frame;

said bracket comprises an open ended member having a closed end and two leg members;

an end member having two ends; and a means for fastening said end member to said open ended member.

2. The system of claim 1 wherein said means for engaging being positioned at said bracket and said proximal end of said support arm.

3. The system of claim 2 wherein said means for engaging said support strap consists of a pair of hooks.

4. The system of claim 1 wherein said support arm extends perpendicularly from said front side of said bracket.

5. The system of claim 1 wherein said support arm is secured to said closed end of said bracket.

6. The system of claim 1 wherein said support arm is integrally molded to said bracket.

7. The system of claim 1 wherein said support arm further comprises:

a means for gripping a gun barrel cleaner.

8. The system of claim 1 further comprising a means for adjusting said opening of said bracket.

9. The system of claim 8 wherein said means for adjusting said opening of said bracket comprises:

a plurality of holes on each said leg members, each hole of said plurality at a different distance from said closed end;

at least one hole on each end of said end member; and a pair of pins, each pin being removably inserted through at least one hole on said end member and in at least one of said plurality of holes on each said leg members.

10. The system of claim 8 wherein said means for adjusting said opening of said bracket comprises:

a plurality of holes on each said leg members, each hole of said plurality at a different distance from said closed end;

each leg member having a cavity, said cavity having a predetermined area;

a protruding element having a plurality of holes and extending from each end of said end member, said protruding element having a predetermined area smaller than said predetermined area of said cavity, such that said protruding element may be telescopically inserted into said cavity; and a pair of pins, each pin being removably inserted in at least one hole of said plurality of holes on each said protruding element and in at least one of said plurality of holes on each said leg member.

11. The system of claim 8 wherein said means for adjusting said opening of said bracket comprises:

an adapter being secured in said opening of said bracket thereby adjusting and adapting the opening of said bracket to accept various sizes and shapes of paintball guns.

12. The system of claim 8 wherein said means for adjusting said opening of said bracket comprises:

a flexible rubber element being attached in said opening of said bracket, said flexible rubber element frictionally gripping a gun inserted into said opening.

13. A gun support system comprising:

a support frame having a bracket and an adjustable support arm;

said bracket being defined by an opening and a front side;

said adjustable support arm having a proximal and distal end, and said adjustable support arm extending outwardly from said front side of said bracket, said distal and proximal ends of said adjustable support arm define a longitudinal axis, and said adjustable support arm being adjustable along said longitudinal axis; and a means for engaging a support strap to said support frame;

said bracket comprises an open ended member having a closed end and two leg members;

an end member; and a means for fastening said end member to said open ended member.

14. The system of claim 13 wherein said adjustable support arm is secured to said closed end of said bracket.

15. The system of claim 14 wherein said support strap engages said support frame at the bracket and distal end of said adjustable support arm.

16. A gun support system comprising:

a support frame having a bracket and an adjustable support arm;

said bracket being defined by an opening and a front side;

said adjustable support arm having a proximal and distal end, and said adjustable support arm extending outwardly from said front side of said bracket;

a means for engaging a support strap to said support frame; and a means for adjusting said opening of said bracket.

17. The system of claim 16 wherein said means for adjusting said opening of said bracket comprises:

a plurality of holes on each said leg members, each hole of said plurality at a different distance from said closed end;

at least one hole on each end of said end member;

a pair of pins, each pin being removably inserted through at least one hole on said end member and in at least one hole of said plurality of holes on each said leg members.

18. A gun support system comprising:

a support frame having a bracket and an adjustable support arm;

said bracket being defined by an opening and a front side;

said adjustable support arm having a proximal and distal end, and said adjustable support arm extending outwardly from said front side of said bracket; and a means for engaging a support strap to said support frame;

said adjustable support arm has a first and a second piece;

said first piece having a cavity, said cavity defined by a predetermined perimeter and having a plurality of holes;

said second piece having a protruding element, said protruding element defined by a perimeter smaller than said perimeter of said cavity and having a plurality of holes; and a pin being removably inserted in at least one hole of said plurality of holes on said first piece and in at least one hole of said plurality of holes on said protruding edge.

19. The system of claim 18 wherein said adjustable support arm further comprises:

a means for gripping a gun barrel cleaner.

* * * * *